US006199541B1

(12) United States Patent
Rogers

(10) Patent No.: US 6,199,541 B1
(45) Date of Patent: Mar. 13, 2001

(54) INTERNAL RAM FUEL DELIVERY

(75) Inventor: Peter T. Rogers, 511 Houston St., Batavia, IL (US) 60510

(73) Assignee: Peter T. Rogers, Batavia, IL (US)

( * ) Notice: Subject to any disclaimer, the term of this patent is extended or adjusted under 35 U.S.C. 154(b) by 0 days.

(21) Appl. No.: 09/299,140

(22) Filed: Apr. 23, 1999

(51) Int. Cl.[7] ..... F02M 37/04
(52) U.S. Cl. ..... 123/507
(58) Field of Search ..... 123/73 C, 507, 123/509

(56) References Cited

U.S. PATENT DOCUMENTS 1,843,606 * 2/1932 Leonard ..... 123/507
2,462,854 * 3/1949 Gates ..... 123/507
2,846,987 * 8/1958 Nettel ..... 123/507
4,048,971 * 9/1977 Pritchett ..... 123/507
5,448,979 * 9/1995 Clarke ..... 123/507
5,473,893 * 12/1995 Achten et al. ..... 60/413
6,050,244 * 4/2000 Wilhelm ..... 123/507

* cited by examiner

*Primary Examiner*—Henry C. Yuen
*Assistant Examiner*—Arnold Castro

(57) ABSTRACT

The Internal Ram Fuel Delivery (IRFD) is a means for utilizing the movement of a reciprocating piston within an internal combustion engine, in conjunction with a secondary piston, or ram, to deliver fuel in the form of a liquid, gas, or an air mixture into a combustion chamber. The two most likely configurations of the IRFD involve either: a ram attached to an engine's primary piston(s) that travels inside a stationary ram cylinder attached to the top of the primary piston's cylinder head, with controlled fuel pathways; or, a ram cylinder attached to, or housed inside of the engine's primary piston(s) which travels on a stationary ram that is attached to the top of the primary piston's cylinder head, with controlled fuel pathways; whereby, the ram and ram cylinder move relative to one another when the engine's primary piston reciprocates, creating a pumping effect that can deliver fuel into a combustion chamber at a predetermined point during the primary piston's travel.

8 Claims, 12 Drawing Sheets

INTERNAL RAM FUEL DELIVERY

FIELD OF INVENTION

This invention relates to an improved and simplified means for timed delivery of fuel—in the form of liquid, vapor, gas, or in combination with air—in reciprocating piston, internal combustion engines.

BACKGROUND DISCUSSION

A variety of controlled fuel delivery means exist for reciprocating piston internal combustion engines. One of the most common involves injecting fuel directly into the combustion chamber, as applied in most diesel and gasoline engines. Injectors connected to external pumps are mechanically complex and require complicated control and timing means. One of the limitations of injectors is in their ability to filly disperse liquid fuel inside of the combustion chamber prior to combustion. Injectors need precise nozzles to improve this situation. In some applications, an air and fuel mixture is injected into the combustion chamber which further improves the fuel dispersion, however, external compressors are typically used for this purpose which become more sophisticated when fuel delivery into higher compression ratio engines is required.

Other known methods of delivering fuel in two-stroke engines involve drawing a fuel and air mixture into an area under the primary reciprocating piston, usually the cylinder and crank case, by the vacuum created by the piston's upstroke. The fuel and air mixture is then pressurized by the subsequent down-stroke. When it reaches the maximum pressure below the piston, the fuel and air mixture is allowed into the combustion chamber, above the piston, using a controlled pathway. At this point, fuel and air is delivered into the combustion chamber prior to the compression stroke, due to the piston being in the down position. Consequently, the fuel and air are compressed together in the combustion chamber by the primary piston, therefore, compression can not exceed the pressure where pre-ignition would occur from the adiabatic heating. Disadvantages which result are: lower potential for efficiency gains that are realized with high compression ratios; the need for an ancillary ignition means to control ignition, plus additives in the fuel such as octane. In addition, the air and fuel mixture is typically used to scavenge the exhaust from the combustion chamber, as in the cross flow configuration which tends to allow fuel to be lost through the exhaust port prior to combustion resulting in further efficiency losses.

In four-stroke engines, when injectors are not involved, the typical fuel delivery occurs during the down stroke of the engine's cycle, when fuel enters the combustion chamber prior to compression which requires limiting the compression ratios.

OBJECTS AND ADVANTAGES

The Internal Ram Fuel Delivery (IRFD) means discussed in the following specifications simplifies the mechanical requirements, as compared to prior methods, for timed delivery of a highly pressurized fuel into highly compressed air within an engine's combustion chamber. The IRFD is also capable of delivering fuel and air mixtures. Delivering an air and fuel mixture into the compressed air within a combustion chamber is a highly effective way to achieve fuel dispersion. The ability to time the delivery of a fuel and air mixture would allow for higher compression of the air within the combustion chamber prior to combustion. In combination, these effects generate better combustion of fuel, resulting in lower emissions and greater fuel efficiency.

The IRFD could be used with low grade fuels in diesel engines, due to its potential for delivering fuel and air/fuel mixtures at high pressures at a predetermined point. The IRFD could potentially be used with non-petroleum alternative fuels.

The IRFD could also be used as a pre-combustion means, which could deliver combustion gasses into the reciprocating piston cylinder.

IRFD can also be applied to the cross-flow gasoline, two-stroke configuration to improve efficiency and to decrease emissions, because fuel would not be lost out the exhaust port. The IRFD could also make the cross-flow engine more efficient by allowing for higher compression ratios and the use of lower grade fuels.

Further advantages of the IRFD will become apparent from consideration of the drawings and ensuing description.

INTRODUCTORY DESCRIPTION

The Internal Ram Fuel Delivery (IRFD) is a fuel delivery means to be used with a reciprocating piston, internal combustion engines. Although the IRFD is potentially viable for use in four-stroke engines, the preferred application is with two-stroke engines, especially those of the cross-flow configuration. Fuel could include any combustible material in the form of a liquid, vapor, gas, or in combination with air—the air and fuel combination being preferred. The main components of the IRFD operate inside the engine's primary cylinders and combustion chamber, in conjunction with reciprocating movement of the engine's main piston.

The IRFD concept could have many possible configurations; however, only two general configurations are most likely to be practical for application. The ensuing portion of the specification will be divided into two parts for separate discussion of these two general configurations.

The first part, titled Configuration I, pertains to a general configuration of the IRFD, including several of the many possible derivative embodiments. In this configuration, a secondary piston, or ram, is attached to the primary piston(s) in an engine and travels inside a stationary ram cylinder which is attached to the top of the primary piston's cylinder.

The second part, titled Configuration II, pertains to another general configuration, including several of its many possible derivative embodiments. The main components are a ram cylinder that is attached to, or housed inside of an engine's primary piston(s) and travels on a stationary ram which is attached to the head of the primary piston's cylinder.

DESCRIPTION OF DRAWINGS

Configuration I

DRAWING REFERENCE NUMERALS

10—ram
12—ram cylinder
14—reciprocating piston
16—ports into the ram
17—exit ports out of the ram
18—ram compression seals (primary)
19—ram compression seals (secondary)
20—fuel intake port
21—fuel intake pathway
22—fuel transfer channels
24—one-way valve
26—grooves
28—outside fuel pathway
30—seals inside of ram cylinder
32—divider
34—spring
36—primary reciprocating piston
38—primary cylinder (for reciprocating piston)
40—connecting rod

CONFIGURATION I

Mechanical Description: Configuration I

Figure 1:
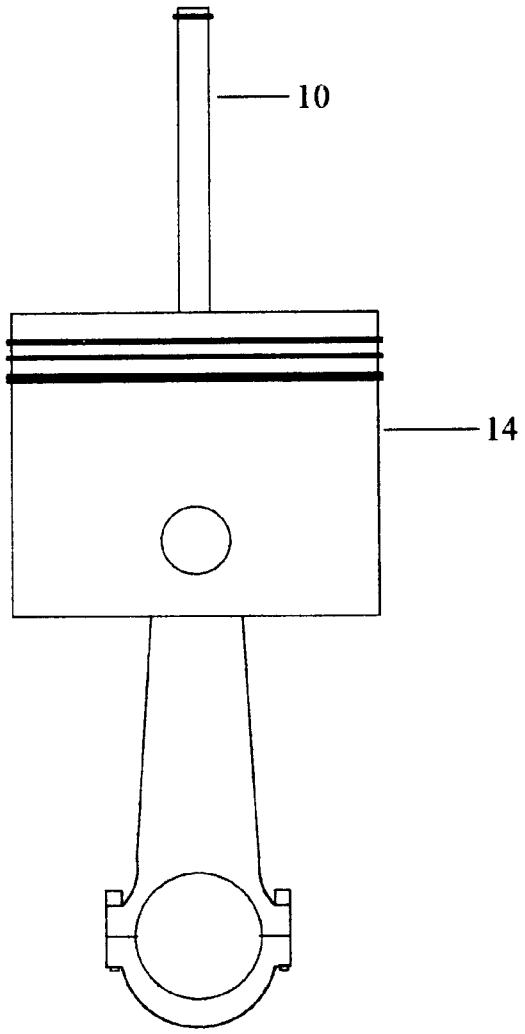
FIG. 1: perspective drawing of the ram attached to the primary reciprocating piston

The fundamental components of Configuration I are: a cylindrical secondary piston, or ram (FIG. 1; 10), which is attached to an engine's primary reciprocating piston(s) (FIG. 1; 14) a stationary ram cylinder which is attached to the top outside of the reciprocating piston's cylinder(s), projecting vertically out of the cylinder head; controlled pathways, such as ports, valves or channels which are used to allow fuel and air into the ram cylinder; and fuel transfer channels which allow comprise grooves or recessions which allow the air/fuel to go past the compression seal of the ram or ram cylinder and enter the combustion area.

Figure 2:
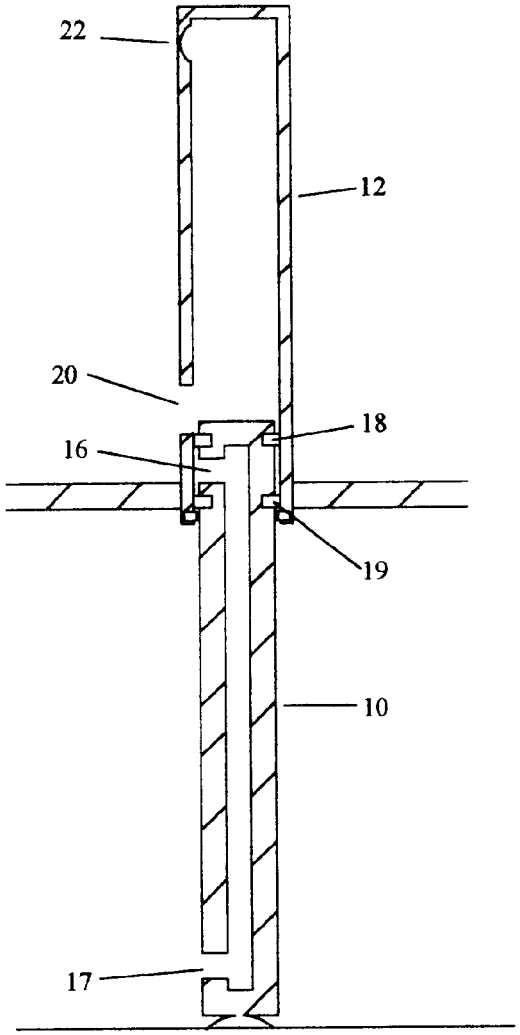
FIG. 2: perspective drawing of Embodiment A, showing inside components

The ram and ram cylinder are constructed preferably out of metal and should be plated, hardened, impregnated or alloyed to improve strength and resilience to friction as the ram travels inside ram cylinder. Embodiments of this configuration are as follows:

Embodiment A: (FIG. 2)

Ports enter the ram at the top (FIG. 2; 16) and exit the ram at the bottom (FIG. 2; 17) Both sets of ports are connected by a bore through the center of the ram. The ports at the top are recessed into a groove and are boarded by primary (FIG. 2; 18) and secondary (FIG. 2; 19) compression seals which encircle the ram. Any type of seal capable of the service requirements could be used such as metal or synthetic rings. Multiple sets of seals may also be necessary.

The top of the ram cylinder is enclosed. An intake port for fuel (FIG. 2; 20) goes through the side of the ram cylinder. Several fuel transfer channels (FIG. 2; 22) are on the inside wall of the ram cylinder which begin at the top, orient parallel to the ram, and terminate where they align with the top ports of the ram when its near the top of its stroke. The bottom of the ram cylinder is open into the reciprocating piston cylinder. In some applications, the ram would go through a seal at the bottom of the ram cylinder which would seat against the ram to seal the ram cylinder from the combustion chamber.

Embodiment B: (FIG. 3)

Figure 3:
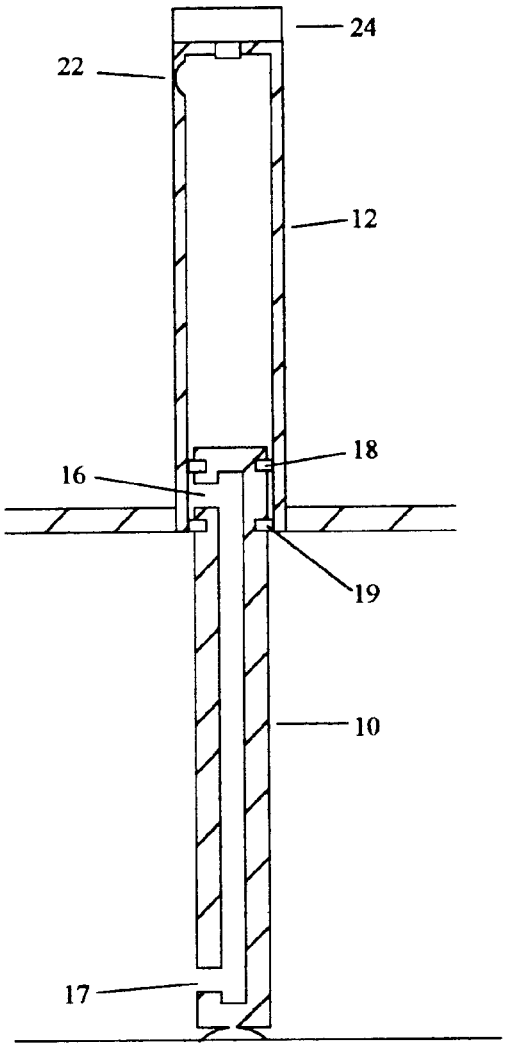
FIG. 3: perspective drawing of Embodiment B, showing inside components

This embodiment is the same as Embodiment A, except a one way intake valve, such as a poppet, solenoid, flap (or other), is used on the top end of the ram cylinder to serve as a means for controlling the fuel intake pathway, instead of a port on the side (FIG. 3; 24).

The seal at the bottom of the ram cylinder that is necessary in some applications of Embodiment A would probably not be necessary.

Figure 4:
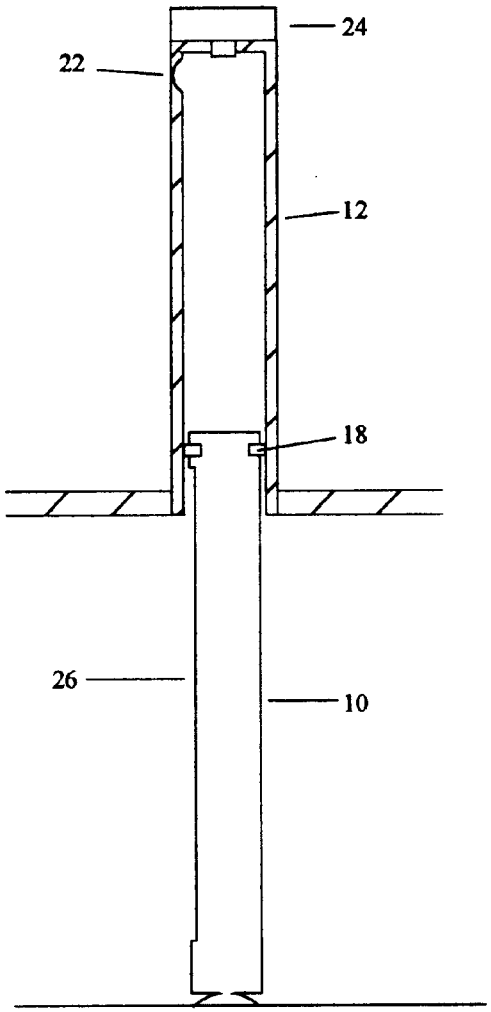
FIG. 4: perspective drawing of Embodiment C, showing inside components

Embodiment C: (FIG. 4)

This embodiment is the same as Embodiment B, except the ram would not have ports on the top connected to ports on the bottom by a bore through the center, instead, grooves (FIG. 4; 26) on the external surface of the ram are used which go from a recessed area below the primary compression seals and terminate near where the ram attaches to the primary piston. Only the primary compression seals encircling the ram above these groves would be necessary (FIG. 4; 18).

Embodiment D: (FIG. 5)

The ram cylinder can have either an intake port on the side as in Embodiment A, or a valved intake as in Embodiment B to serve as a control means for fuel intake. The primary differences are in regard to the ram and the fuel pathway out of the ram cylinder and into the combustion chamber.

In this embodiment, a fuel pathway goes outside of the ram cylinder (FIG. 5; 28), instead of through the ram, or between the ram and the ram cylinder as in the previous embodiments. An outside fuel pathway—comprising either an external tube, or a void between an external sleeve and the ram cylinder which can be created by enclosing a groove in the outside of the ram cylinder with an external sleeve—originates near the top of the ram cylinder and reenters the ram cylinder near the bottom, through a port between two seals circumscribing the interior of the ram cylinder (FIG. 5; 30). This area between these seals can be recessed.

Figure 5:
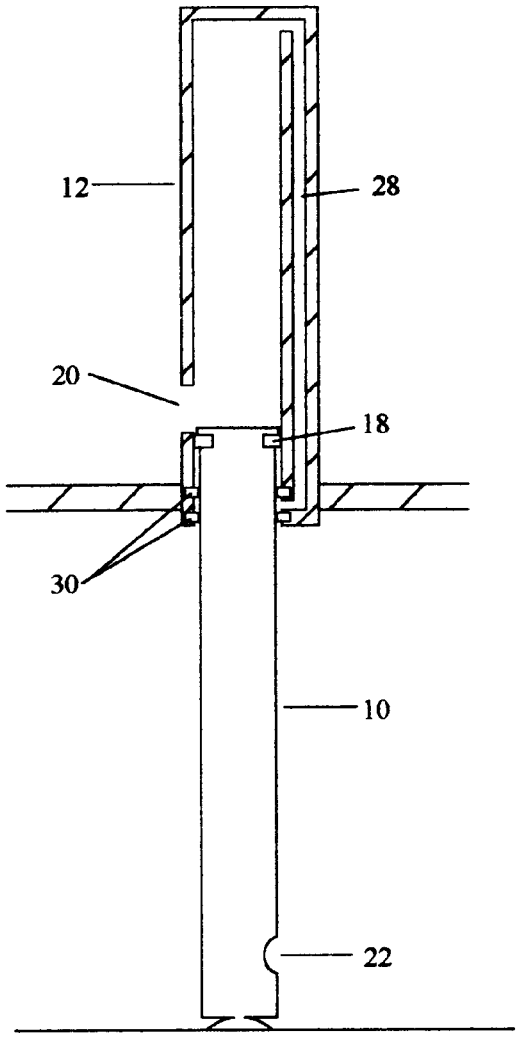
FIG. 5: perspective drawing of Embodiment D, showing inside components

The ram is solid (with no ports) (FIG. 5; 10). A seal encircles it at the top (FIG. 5; 18). Fuel transfer channels (FIG. 5; 22) begin near the bottom of the ram, where it attaches to the engine's primary piston, and terminate where they will align past the bottom seal inside the ram cylinder (FIG. 5; 30) when the ram is near the top of its stroke.

Figure 6:
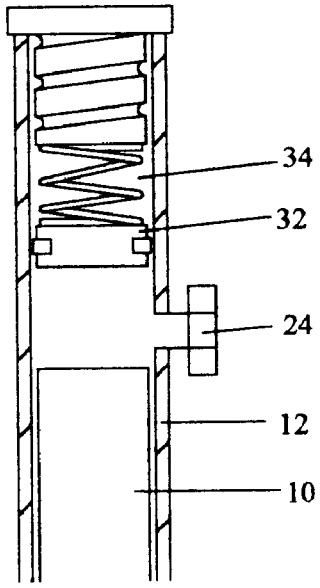
FIG. 6: cross section drawing of an expansion chamber, showing inside components Configuration II

Expansion Chamber: (FIG. 6)

All the embodiments can be used with an expansion chamber when incompressible liquid fuel is to be used. An expansion chamber is an area of the ram cylinder above the intake pathway and fuel transfer channels. It comprises a piston-like divider that is encircled by a seal (FIG. 6; 32). The divider is attached to a spring (FIG. 6; 34) which is attached to the enclosed end of the ram cylinder. A means to adjust the spring pressure, can also be employed.

Operation Description: Configuration I

The Internal Ram Fuel Delivery (IRFD) is a fuel delivery means to be used with reciprocating piston, internal combustion engines. The IRFD can be used in both two-stroke and four-stroke engines, but its application would be best suited for use with two-stroke engines. The IRFD can be designed to use a variety of fuels. Fuel could include any combustible material in the form of liquid, vapor, gas, or combined with air—the IRFD preferred use is with fuel combined with air.

The fundamental components of Configuration I operate in an engine's primary cylinders and combustion chamber in conjunction with the reciprocating movement of the engine's main piston(s). These components are: a cylindrical secondary piston, or ram (FIG. 1; 10), which is attached to the primary reciprocating piston(s) (FIG. 1; 14); a stationary ram cylinder(s) which is attached to the top outside of the reciprocating piston's cylinder, projecting vertically through the cylinder head; controlled pathways, such as ports, valves or channels which are used to direct fuel; and fuel transfer channels which allow the fuel into the combustion chamber at a predetermined point by allowing fuel/air to go around the compression seal.

The operation cycle of IRFD is initiated with the ram traveling toward its lowest position in the ram cylinder (this occurs simultaneously with the main piston's down-stroke). The vacuum created by the expanding volume in the cylinder draws fuel through a controlled pathway into the ram cylinder. Seals on the ram keep the fuel and air mixture above the ram and the controlled pathway prevents fuel from exiting. During the subsequent upstroke of the ram, the air and fuel mixture is compressed, until a predetermined point when fuel transfer channels allow the fuel and air mixture to pass into the combustion chamber.

The fuel enters the combustion chamber where it combines with air that has been supplied by conventional means and compressed by the primary piston. When the fuel and air mixture combines with the air in the combustion chamber, in the presence of adequate heat, combustion results. The expanding combustion gases drive the primary piston and ram down, and the cycle is perpetuated.

If the IRFD is to be used in a four-stroke engine, the fuel being supplied to the ram cylinder would have to be limited to only the combustion cycle requiring a means to sequence fuel supply to the ram cylinder.

To use the IRFD with a incompressible fuel, such as an all liquid fuel, an expansion chamber can be used in the top end of the ram cylinder. One potential expansion chamber embodiment (FIG. 6) involves a sealed piston-like divider (FIG. 6; 32) which would slide in the top portion of the ram cylinder. This divider is connected to a spring (FIG. 6; 34) which will allow for the displacement of the fuel when the ram pushes it to the top. At the moment of fuel exchange, the recoil of the spring pushes the fuel through a pathway, such as the fuel transfer channels, into the combustion chamber.

Specific embodiments of the IRFD derived from the preceding operating principle will be described in the following discussion.

Embodiment A: (FIG. 2)

When the ram is in the down position it uncovers a port (FIG. 2; 20) in the ram cylinder (FIG. 2; 12) allowing air and fuel mixture into the ram cylinder. When the ram moves up it covers this port so the fuel can not exit. The fuel is then pressurized by the subsequent upward stroke of the ram.

When the ram reaches the top of the ram cylinder, the ports on the top of the ram (FIG. 2; 16) align with the vertical fuel transfer channels (FIG. 2; 22) at the top of the ram cylinder. These channels allow fuel to travel around the top seal of the ram (FIG. 2; 18) and into the ports on the ram. The ports at the top of the ram are conjoined by a groove, or a recess, which facilitates fuel transfer from multiple fuel transfer channels. The lower seal on the ram (FIG. 2; 19) remains below the fuel transfer channels to keep fuel from going past the ram's ports. The fuel transfer channels should be constructed to allow the ram's top compression seal to slide past easily by maintaining some area between the channels which remains continuous with the ram cylinder bore.

The pressurized fuel completes its transfer down a hollow bore through the center of the ram, then exits through the exit ports (FIG. 2; 17) into the combustion chamber.

To avoid back-flow of exhaust gas into the ram cylinder or out of the intake, through the ports in ram, the opening of the intake port should be sequenced to occur after the exhaust port in the main cylinder opens to allow the main cylinder to decompress.

A seal between the ram cylinder and the main combustion area may be necessary on the ported intake configuration to prevent combustion gasses from escaping through the ram cylinder and out of the intake port. Such a seal would need to be tolerant of high temperatures, pressures and friction.

Embodiment B: (FIG. 3)

This embodiment is mechanically and operationally similar to Embodiment A, except a one-way intake valve (FIG. 3; 24), such as a poppet, solenoid, flap, ball, or other, is used on the top end of the ram cylinder to serve as a means for controlling the fuel intake pathway instead of a port that is covered by the ram.

In addition, the seal between the ram cylinder and the combustion chamber would not be necessary, because there would not be any potential exit pathways below the ram compression seals for combustion blow-by to escape. However, such a seal may improve isolating the ram cylinder from combustion gas pressure, helping the ram seals to hold a vacuum during the fuel intake cycle.

Embodiment C: (FIG. 4)

The ram cylinder is mechanically the same as in Embodiment B, whereby a one-way valve acts as the control means for the fuel intake pathway and fuel transfer channels are inside near the top; however, the ram does not have ports connected to a fuel transfer pathway through the center, which in the previous embodiment conveys pressurized fuel into the combustion chamber. Instead, grooves on the outside of the ram (FIG. 5; 26) are used. When the ram's top seal passes the fuel transfer channels in the ram cylinder, the fuel travels around the seal, through the fuel transfer channels and down a space between the ram and the ram cylinder created by the grooves cut into the ram. The grooves are below the ram's top seal where they begin at a recessed groove which encircles the ram cylinder. The recessed groove on the ram facilitates quicker distribution of pressurized fuel coming from the from multiple fuel transfer channels in the ram cylinder, going into the grooves on the ram.

This embodiment could operate in the same manner without grooves in the ram by using only the space between the ram and the ram cylinder as the pathway for transfer of pressurized fuel into the combustion chamber.

The seal that is at the bottom of the ram cylinder, necessary in Embodiment A, in addition to the secondary seals on the ram necessary in both Embodiment A and Embodiment B, would not be necessary. Only seals above the grooves on the ram are necessary. Due to the potential to operate with fewer seal combinations, this embodiment is preferred.

Embodiment D:

The ram cylinder can have either an intake port on its side as in Embodiment A, or a valved intake as in Embodiment B to serve as a means for controlling the fuel intake pathway. The primary differences are in regard to the ram and the fuel transfer pathway out of the ram cylinder and into the combustion chamber.

In this embodiment, a fuel transfer pathway goes outside of the ram cylinder (FIG. 5; 28) instead of through the ram, or between the ram and ram cylinder as in the previous embodiments. This pathway originates near the top of the ram cylinder at a port(s) bordered by seals on the inside of the ram cylinder (FIG. 5; 30) and terminates near the bottom, comprising either an external tube, or a void between an external sleeve and the ram cylinder which can be created by enclosing a groove in the outside of the ram cylinder. Pressurized fuel from the top of the ram cylinder is blocked by the ram and the seals keep the fuel from leaking past. When the ram is in the position where several fuel transfer channels (FIG. 5; 22) in the lower portion of the ram breach the lower seal, the fuel is allowed to transfer into the combustion chamber. The position of the fuel transfer channels relative to the seals in the bottom of the ram cylinder will determine when fuel transfer into the combustion chamber will occur.

CONFIGURATION II

Mechanical Description: Configuration II

The fundamental components of Configuration II are: a ram cylinder connected to, or housed inside of, an engine's primary reciprocating piston(s) (which is enclosed on one end, and should be sleeved with a material capable of withstanding heat and friction); a stationary ram which is attached to the top, or head, of the primary pistons cylinder and projects vertically into the engine; and controlled pathways (ports, valves or channels) which are used to direct fuel and air.

Most of the mechanical components in this configuration are analogous to those of Configuration I. Any discussion of the general properties of IRFD in Configuration I would apply for Configuration II.

A mechanical description of several possible embodiments of Configuration II are as follows:

Embodiment E: (FIG. 7)

Figure 7:
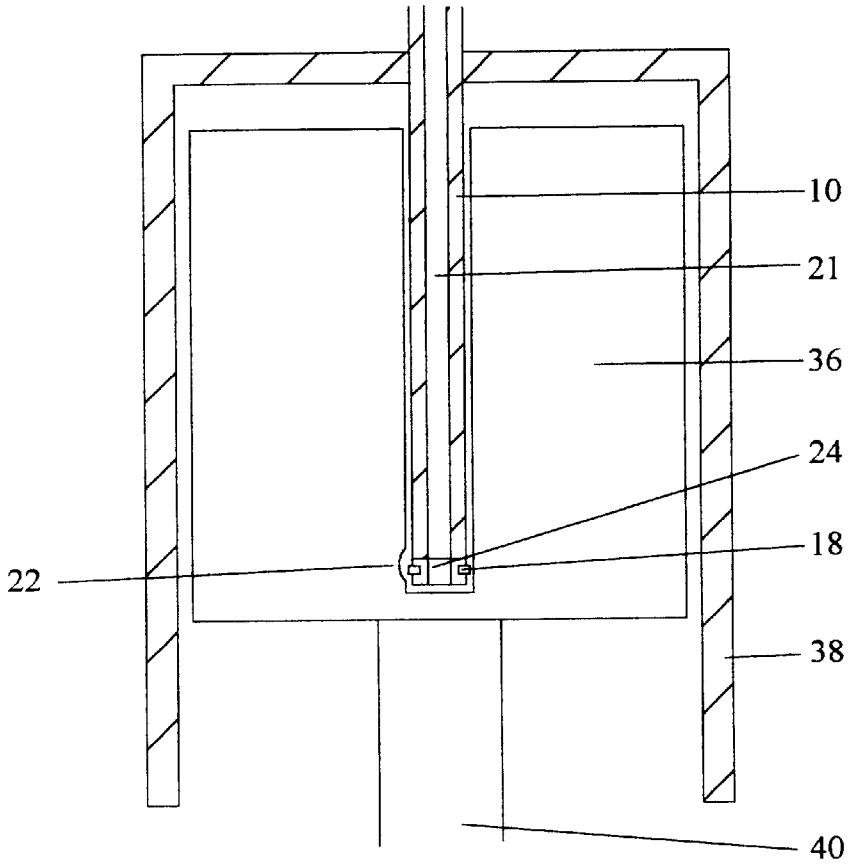
FIG. 7: cross section of Embodiment E, showing the internal components of the ram and ram cylinder inside an engine's primary reciprocating piston—the reciprocating piston is at the top of its stroke

A one way intake valve (FIG. 7; 24) such as a poppet, solenoid, flap, or a similar control means, is used as a means for controlling the fuel intake pathway (FIG. 7; 21) through the center of the ram (FIG. 7; 10). A primary compression seal (FIG. 7; 18) encircles the ram at the bottom (the end opposite to the one attached to the engines cylinder head). Grooves (FIG. 7; 26) go from a recessed area below the top seal and terminate near the top of the ram, which can be made by cutting grooves into the external surface of the ram.

Several fuel transfer channels (FIG. 7; 22) are on the inside wall of the ram cylinder, or sleeve, which begin at the bottom travel upward and terminate where they would align with groves in the ram when the engine's reciprocating piston carries the ram cylinder to the top of its stroke.

Embodiment F: (FIG. 8 & 9)

Figure 8:
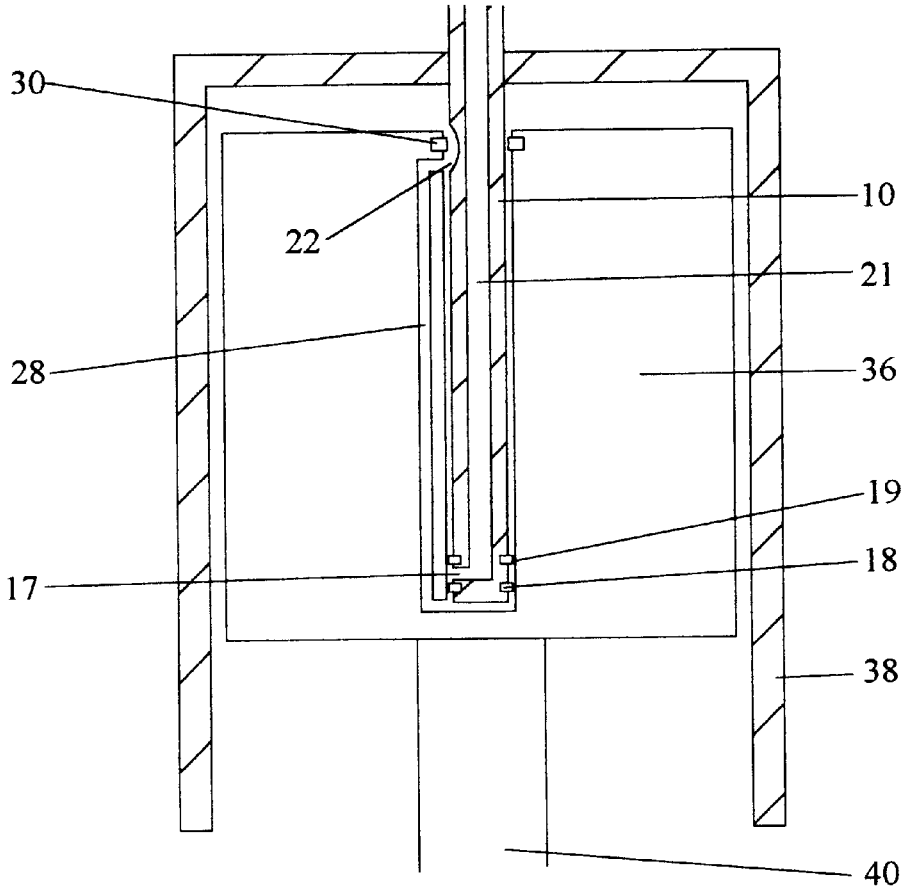
FIG. 8: cross section of Embodiment F, showing the internal components of the ram and ram cylinder inside an engine's primary reciprocating piston—the piston is at the top of its stroke with the ram and ram cylinder in the fuel transfer position
Figure 9:
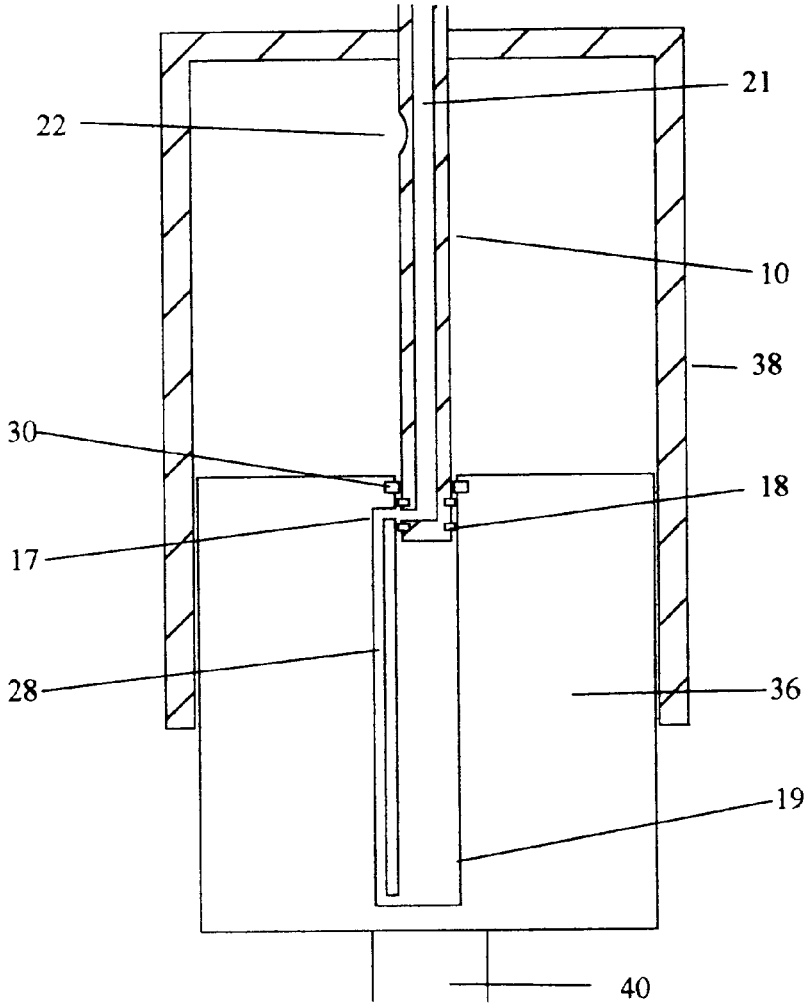
FIG. 9: cross section of Embodiment F, showing the internal components of the ram and the ram cylinder inside an engine's primary reciprocating piston—the piston is at the bottom of its stroke with the ram and ram cylinder in the fuel intake position

The ram has a fuel intake pathway through the center (FIG. 8; 21). A Port(s) (FIG. 8; 17) goes through the side of the ram connecting to the fuel intake pathway and is bordered by compression seals (FIG. 8; 18 & 19) which encircle the ram. If multiple ports are used, the ports can be recessed into a groove which facilitates distribution between ports. Any type of seal capable of the service requirements could be used such as metal compression rings or synthetic rings. Multiple sets of seals may be necessary. Fuel transfer channels (FIG. 8; 22) begin near the top of the ram where it attaches to the engine's cylinder head, and terminate where they will align past the seal at the top, inside, of the ram cylinder (FIG. 8; 30).

The top of the ram cylinder (the end near the combustion chamber) has a seal (FIG. 8; 30) which seats against the ram. A fuel transfer pathway goes outside of the ram cylinder (FIG. 8; 28) connecting at the top and bottom of the ram cylinder and comprising of either a channel through the reciprocating piston, or a void between the ram cylinder sleeve and the bore in which it housed within the reciprocating piston.

Figure 10:
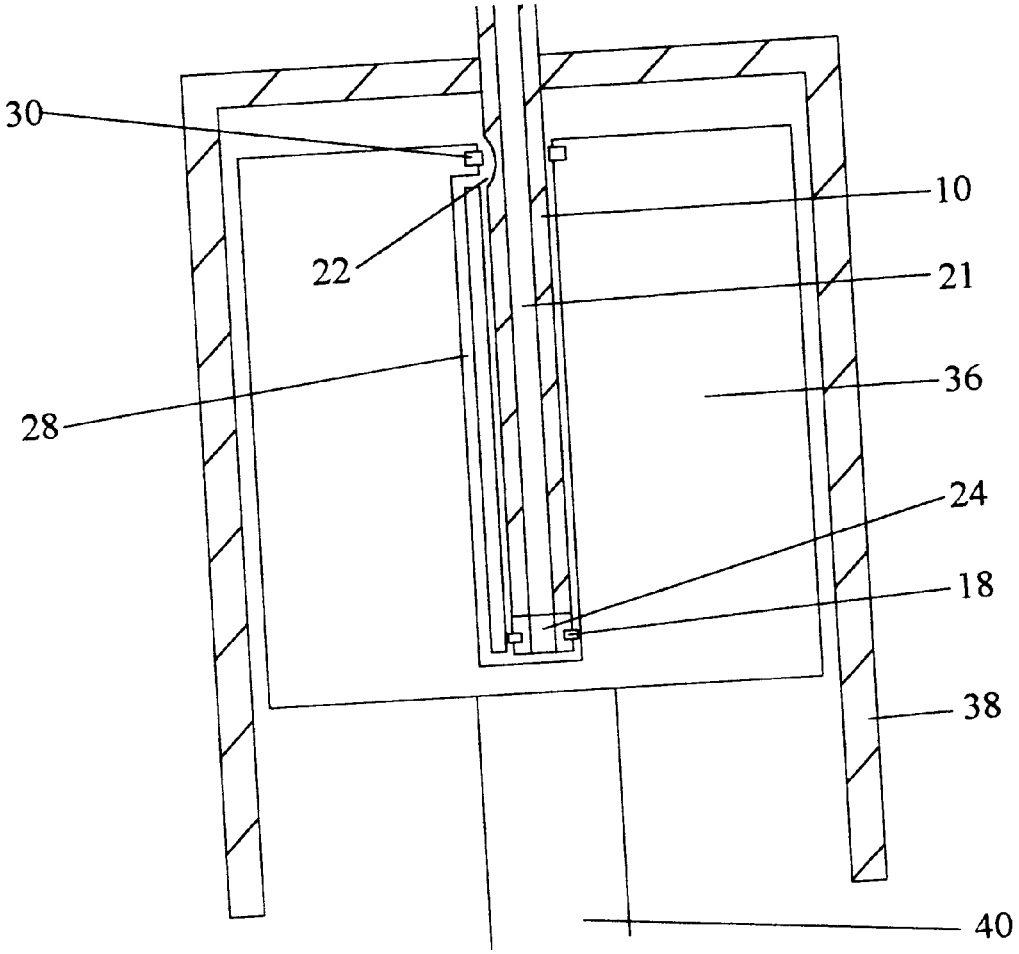
FIG. 10: cross section of Embodiment G, showing the internal components of the ram and the ram cylinder inside an engine's primary reciprocating piston

Embodiment G: (FIG. 10)

This embodiment is the same as Embodiment B, except a one way valve (FIG. 10; 24) is used as a means for controlling the fuel intake pathway through the center of the ram, instead of a port on the side of the ram The fuel intake pathway terminates at the bottom, center of the ram.

Figure 11:
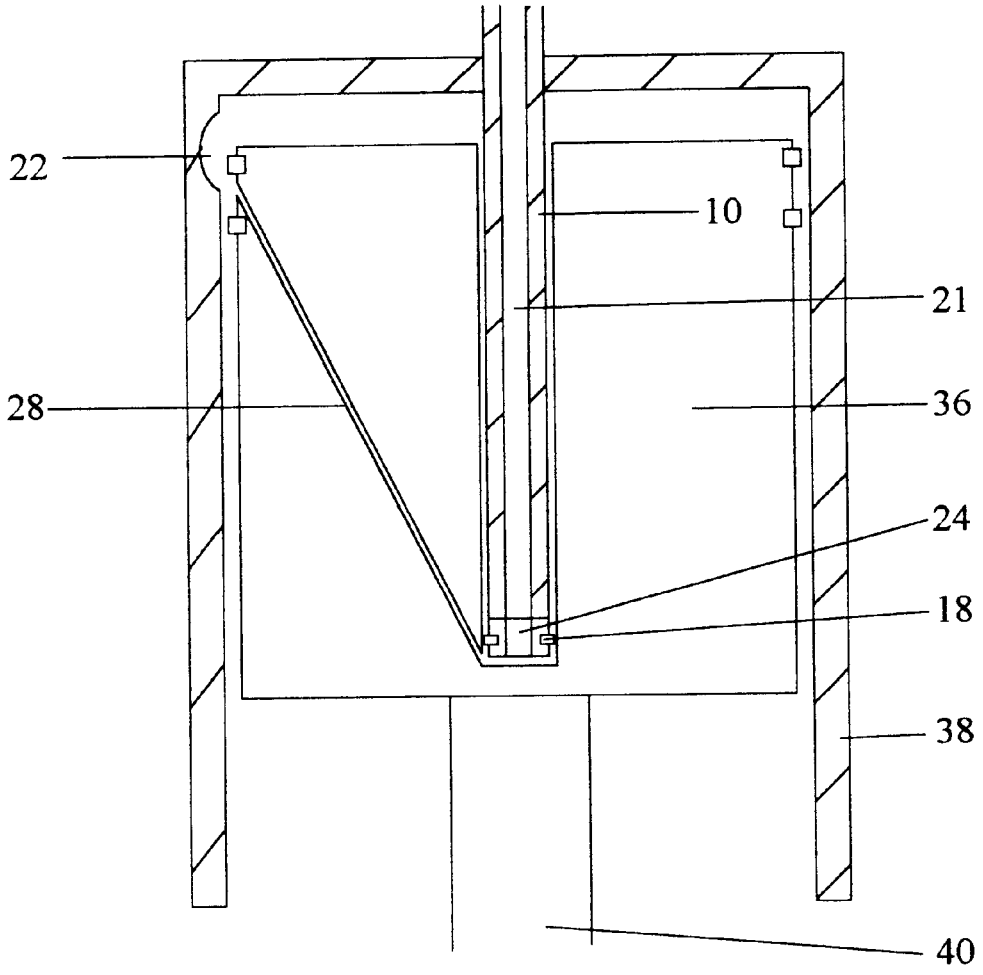
FIG. 11: cross section of Embodiment H, showing the internal components of the ram and ram cylinder inside an engine's primary reciprocating piston

Embodiment H: (FIG. 11)

The ram has a fuel intake pathway through the center (FIG. 11; 21), terminating at the bottom center of the ram. The fuel intake pathway is controlled by a one way valve (FIG. 11; 24). A primary compression seal encircles the ram near the bottom end (FIG. 11; 26).

A fuel pathway exits from the bottom of ram cylinder and continues through the reciprocating piston, terminating at a recessed area between two of the piston's compression rings at the piston's outer periphery. Fuel transfer channels are at the top of the engine's main cylinder wall (FIG. 11; 22).

The fuel transfer channels in the main cylinder wall and the terminus of the fuel pathway on the periphery of the reciprocating piston should occupy positions that will not align with the intake and exhaust ports of the main piston and cylinder.

Embodiment I: (FIG. 12)

The fuel pathway and ports on the ram in this embodiment are similar to Embodiment B.

Figure 12:
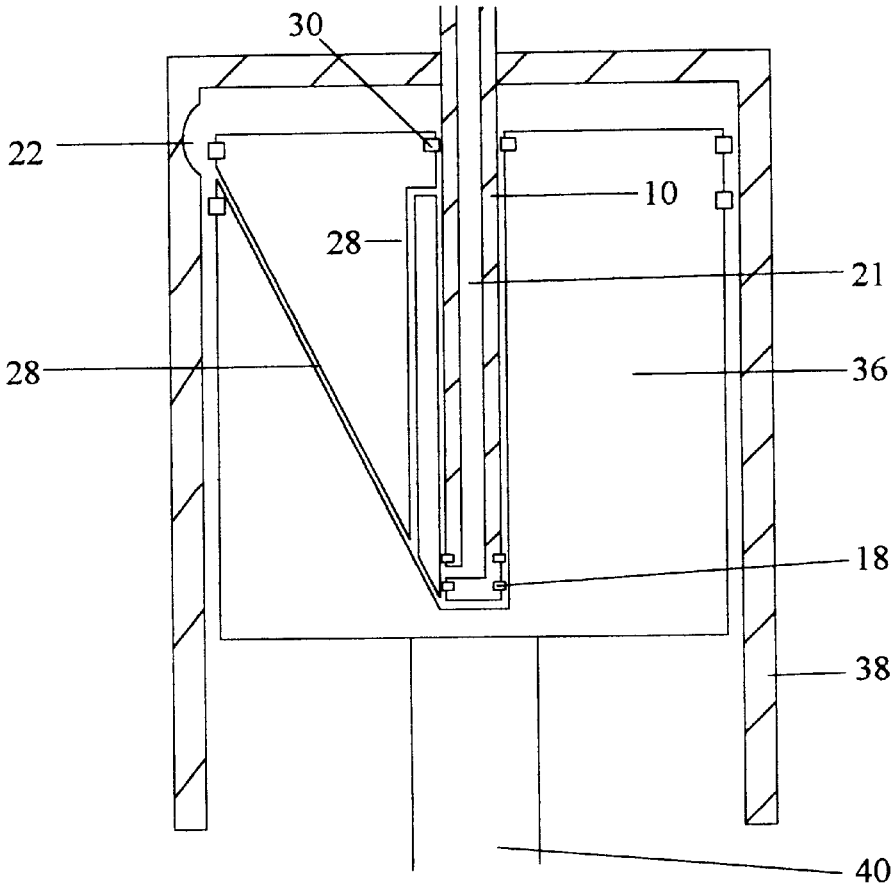
FIG. 12: a cross section of Embodiment I, showing the internal components of the ram and ram cylinder inside an engine's primary reciprocating piston

The top, inside, of the ram cylinder has a seal seats against the ram (FIG. 12; 30). An outside fuel transfer pathway (FIG. 12; 28) connects at the top and bottom of the ram cylinder, comprising of either; a channel through the reciprocating piston of a void between the ram cylinder's sleeve and the bore in which it is housed within the reciprocating piston. A fuel pathway exits the bottom of the ram cylinder, continues through the reciprocating piston and terminates at a recessed area between two of the piston's compression rings at the piston's outer periphery. Fuel transfer channels are at the top of the engine's main cylinder wall (FIG. 12;22) should occupy positions in cross-flow engines that will not align with the intake and exhaust ports of the main piston and cylinder.

Primary Reciprocating Piston Embodiments for Configuration II:

The primary piston may need to be configured to house the ram cylinder by allowing room between a fork shaped connecting rod or other means.

Operation Description: Configuration II

Many of the principles of operation previously discussed for Configuration I apply fundamentally to Configuration II, despite their being structurally very different from one another.

In Configuration II, a ram cylinder is attached to (housed inside of) an engine's primary piston(s) and travels on a stationary ram which is attached to the top of the primary piston's cylinder. When the movement of the reciprocating cylinder is initiated, the ram and the ram cylinder move relative to one another creating a pumping effect in coordination with controlled fuel pathways to deliver fuel in to the combustion chamber, in a similar manner as in Configuration I.

The specific aspects of operation for several embodiments which are derived from the general Configuration II are discussed in the following.

Embodiment E: (FIG. 7 )

A one way valve (FIG. 7; 24) such as a poppet, solenoid, flap, or similar type of control means, is used for controlling the fuel intake pathway (FIG. 7; 21) through the center of the ram. Fuel is drawn through this valve, through the ram and into the ram cylinder during the reciprocating piston's down stroke. During the subsequent upstroke, the ram cylinder rises on the ram (FIG. 7; 10), the one way intake valve keeps the fuel in the ram cylinder while it is compressed A primary compression seal (FIG. 7; 18), which encircles the ram, keeps the fuel from going past the ram.

When the primary compression seal on the ram passes the fuel transfer channels in the ram cylinder, the fuel travels around the seal, through the fuel transfer channels, up the grooves on the ram, or a space between the ram and the ram cylinder, and into the combustion chamber. The recessed area (FIG. 7; 26) above the seal, where grooves on the ram connect, facilitate quicker fuel distribution to multiple fuel transfer channels.

Embodiment F: (FIG. 8 & 9)

An outside fuel pathway (FIG. 8; 28) connects the bottom of the ram cylinder to the top. A seal (FIG. 8; 30) is in the top, inside of the ram cylinder which seats against the ram. When the hole, or port, where the outside fuel pathway enters the ram cylinder is blocked by the ram, a vacuum in the ram cylinder is maintained during its down stroke on the ram. When a fuel intake port(s) on the bottom of the ram aligns with the port of the outside fuel pathway, which is the position depicted in FIG. 9, fuel is drawn through fuel intake pathway through the center of the ram (FIG. 8; 21), through the outside fuel pathway and into the ram cylinder. When the ram moves and the port is no longer aligned with the outside fuel pathway's top opening, the fuel is confined in the ram cylinder and compressed by the ram until the fuel transfer channels (FIG. 8; 22) breach the seal in the top inside of the ram cylinder (FIG. 8; 30) allowing the fuel to transfer into the combustion chamber, which is the position depicted in FIG. 8.

Embodiment G: (FIG. 10)

This embodiment is similar to Embodiment B, except that a one way valve (FIG. 10; 24) is used on the fuel intake pathway through the ram, instead of the ram ports which align with the top port of the fuel pathway.

The fuel pathway which connects to the bottom and top of the ram cylinder, and is covered by the ram, is used in the transfer of pressurized fuel into the combustion chamber when the fuel transfer channels, which comprise a recessed area on the ram (groove) breach the ram cylinder seal (FIG. 10; 30).

Embodiment H: (FIG. 11)

The process of fuel intake into the ram cylinder is similar the process discussed for Embodiment A.

Fuel delivery into the combustion chamber occurs when the fuel pathway going out of the ram cylinder through the piston (FIG. 11; 28) aligns with the fuel transfer channels (FIG. 11, 22) in the reciprocating piston's cylinder wall. Prior to the alignment, the fuel pathway is blocked by the reciprocating piston's cylinder wall. The fuel transfer channels allows the pressurized fuel to go past the primary compression rings on the reciprocating piston, into the combustion chamber.

Embodiment I: (FIG. 12)

The process of fuel intake into the ram cylinder is the same for this embodiment as discussed for Embodiment B.

The fuel delivery occurs in the same manner as in Embodiment D.

Further Considerations for IRFD:

In the application of the IRFD, several of the following parameters should be considered:

Pressure exchange from the ram cylinder into the combustion area, or fuel delivery, is only possible if the fuel pressure in the ram cylinder is greater than the air pressures in the combustion chamber; therefore, the ram and its cylinder, accounting for fuel pathways, will need to be have a higher compression ratio than the primary piston and its cylinder.

The IRFD and associated fuel pathway control means should be configured so fuel exchange into the combustion chamber will occur at the appropriate moment during the primary piston's stroke to optimize ignition timing.

When using the IRFD for fuel and air mixtures, the ram displacement should be big enough to satisfy the maximum fuel needs of the primary cylinder, yet small enough to always maintain a rich enough mixture to prevent pre-combustion in the ram cylinder caused by adiabatic heating during compression—except in applications where pre-combustion is desired. When an air and fuel mixture is supplied to the intake, a means for achieving a predetermined ratio such as a jet, injector, or other will be needed.

Fuel pathways (ports or fuel transfer channels) in the ram could be also oversized to transfer combustion gas when pre-combustion in the ram cylinder is desired.

Provisions for cooling and lubrication should be made in the IRFD depending upon the application.

Only materials, especially when considering seals, capable of satisfying the operating demands should be used in the IRFD.

What is claimed is:

1. A fuel injection system for an internal combustion engine having a head and a cylinder, and having a primary piston reciprocatively mounted in the cylinder comprising:

a. a stationary secondary piston, or ram for utilizing the reciprocating movement of said primary piston, b. a ram cylinder attached to said primary reciprocating piston in communication with said stationary secondary piston, or ram, c. means for delivering fuel of any form including liquid, vapor, gas, in combination with air, or combusted mixture, into a combustion area associated with said primary reciprocating piston at any predetermined point during said primary reciprocating piston's compression stroke.

2. A fuel injection system for an internal combustion engine having a head and a cylinder, and having a primary piston reciprocatively mounted in the cylinder comprising:

a. a secondary piston, or ram for utilizing the reciprocating movement of said primary piston, b. a ram cylinder in communication with said secondary piston, or ram, c. a plurality of fuel transfer channels, d. means for utilizing fuel transfer channels and the reciprocating movement of said primary piston, to deliver fuel of any form including liquid, vapor, gas, in combination with air or combusted gases, into a combustion area associated with said primary reciprocating piston at any predetermined point during said primary reciprocating piston's compression stroke.

3. A fuel injection system for an internal combustion engine as described in claim 2, wherein said ram is in a stationary position attached to the cylinder head associated with said primary reciprocating piston and said ram cylinder is attached to said primary reciprocating piston.

4. A fuel injection system for an internal combustion engine as described in claim 3, wherein said fuel transfer channels comprise recessed areas on said ram cylinder.

5. A fuel injection system for an internal combustion engine as described in claim 3, wherein said fuel transfer channels comprise recessed areas on said ram.

6. A fuel injection system for an internal combustion engine as described in claim 2, wherein said ram is attached to said primary reciprocating piston and said ram cylinder is stationary.

7. A fuel injection system for an internal combustion engine as described in claim 6, wherein said fuel transfer channels comprise recessed areas on said ram.

8. A fuel injection system for an internal combustion engine as described in claim 6, wherein said fuel transfer channels comprise recessed areas on said ram cylinder.

* * * * *